US009200881B1

(12) United States Patent
Langner

(10) Patent No.: US 9,200,881 B1
(45) Date of Patent: Dec. 1, 2015

(54) SYSTEMS AND METHODS FOR AN IMPROVED FIRING ASSEMBLY

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days.

(21) Appl. No.: 14/467,927

(22) Filed: Aug. 25, 2014

Related U.S. Application Data

(63) Continuation-in-part of application No. 13/616,987, filed on Sep. 14, 2012, now Pat. No. 8,915,004.

(60) Provisional application No. 61/659,414, filed on Jun. 13, 2012, provisional application No. 61/628,006, filed on Oct. 24, 2011, provisional application No. 61/628,115, filed on Oct. 25, 2011.

(51) Int. Cl.
*F42D 5/04* (2006.01)
*F41A 19/06* (2006.01)

(52) U.S. Cl.
CPC .. *F42D 5/04* (2013.01); *F41A 19/06* (2013.01)

(58) Field of Classification Search
CPC ..... F42B 33/06; F42B 33/062; F42B 33/00; F42B 12/02; F42D 5/04; F41A 19/06
USPC ..... 42/69.01–69.03; 89/1.13, 27.11; 124/56, 63, 64, 65, 74; 86/50
See application file for complete search history.

(56) References Cited

U.S. PATENT DOCUMENTS

| | | | | |
|---|---|---|---|---|
| 2,337,145 A | | 12/1943 | Albree | |
| 2,479,582 A | | 8/1945 | McCaslin | |
| 2,436,396 A | | 2/1948 | McCaslin | |
| 2,780,882 A | | 11/1953 | Temple | |
| 2,935,001 A | | 6/1955 | Buecker | |
| 2,719,486 A | | 10/1955 | Plumley | |
| 2,869,563 A | | 1/1959 | Schoengrun | |
| 2,961,956 A | | 11/1960 | Townsend | |
| 3,065,560 A | | 11/1962 | Bumiller | |
| 3,453,764 A | | 6/1969 | Grolleau | |
| 3,603,258 A | | 9/1971 | Green | |
| 3,762,087 A | | 10/1973 | Strubin | |
| 4,009,536 A | | 3/1977 | Wolff | |
| 4,169,403 A | * | 10/1979 | Hanson | F42B 33/062 102/293 |
| 4,757,629 A | | 7/1988 | Austin | |
| 4,779,511 A | * | 10/1988 | Proctor | F42B 33/06 86/50 |
| 4,928,574 A | | 5/1990 | Golden | |
| 5,134,921 A | * | 8/1992 | Breed | F41A 23/06 86/50 |
| 5,136,920 A | | 8/1992 | Breed | |
| 5,148,750 A | | 9/1992 | Becker | |
| 5,411,225 A | * | 5/1995 | Lannon | F42B 6/10 102/505 |
| 5,454,323 A | | 10/1995 | Conil | |
| 5,458,369 A | | 10/1995 | Matsuki | |
| 5,460,094 A | | 10/1995 | Ono | |
| 5,564,747 A | | 10/1996 | Ono | |
| 5,743,246 A | | 4/1998 | Mattern | |

(Continued)

FOREIGN PATENT DOCUMENTS

| | | |
|---|---|---|
| EP | 0051119 | 2/1985 |
| EP | 0120215 | 1/1987 |

(Continued)

*Primary Examiner* — Joshua Freeman
(74) *Attorney, Agent, or Firm* — Lawrence Letham; Letham Law Firm LLC

(57) ABSTRACT

Methods and apparatus of a firing assembly for activating a cartridge to launch a projection from a disrupter cannon to disable or destroy an explosive device.

18 Claims, 4 Drawing Sheets

(56) References Cited

U.S. PATENT DOCUMENTS

| | | | | |
|---|---|---|---|---|
| 5,785,038 | A * | 7/1998 | Mattern | B09B 3/0058 124/56 |
| 5,844,163 | A | 12/1998 | Lindskog | |
| 6,272,996 | B1 | 8/2001 | O'Brien | |
| 6,439,127 | B1 * | 8/2002 | Cherry | F42B 12/36 102/402 |
| 6,644,166 | B2 * | 11/2003 | Alexander | F41B 11/00 102/275.11 |
| 6,732,464 | B2 | 5/2004 | Kurvinen | |
| 7,066,093 | B2 | 6/2006 | Ronn | |
| 7,481,146 | B2 * | 1/2009 | Weiss | F41A 19/58 102/293 |
| 7,541,563 | B1 * | 6/2009 | Pal | F41A 19/59 102/200 |
| 7,555,977 | B2 | 7/2009 | Crotty | |
| 7,712,417 | B1 | 5/2010 | Einstein | |
| 7,905,182 | B2 | 3/2011 | Janik | |
| 7,997,179 | B1 * | 8/2011 | Nelson | F41A 11/02 181/110 |
| 8,042,296 | B1 | 10/2011 | Kirstein | |
| 8,245,430 | B1 | 8/2012 | Owenby | |
| 2003/0041722 | A1 | 3/2003 | Alexander | |
| 2003/0047062 | A1 * | 3/2003 | Alexander | F41B 11/00 86/50 |
| 2007/0278779 | A1 | 12/2007 | Arnold | |
| 2008/0282922 | A1 | 11/2008 | Land | |
| 2009/0178548 | A1 | 7/2009 | Tyas | |
| 2010/0212481 | A1 * | 8/2010 | Koth | F41A 1/00 89/7 |
| 2011/0214583 | A1 | 9/2011 | Dutch | |
| 2012/0174813 | A1 | 7/2012 | Battaglia | |

FOREIGN PATENT DOCUMENTS

| | | |
|---|---|---|
| EP | 0424057 | 3/1995 |
| EP | 0784778 | 1/2001 |
| EP | 1055096 | 5/2005 |
| GB | 271925 | 5/1927 |
| GB | 224319 | 11/1934 |
| GB | 470250 | 8/1937 |
| GB | 2193797 | 2/1988 |
| WO | 2006088384 | 8/2006 |

* cited by examiner

SYSTEMS AND METHODS FOR AN IMPROVED FIRING ASSEMBLY

CROSS-REFERENCE TO RELATED APPLICATIONS

This application is a continuation-in-part of and claims priority under 35 U.S.C. §120 from U.S. patent application Ser. No. 13/616,987 filed Sep. 14, 2012, which claims priority under 35 U.S.C. §119(e) from U.S. provisional patent application Nos. 61/659,414 filed Jun. 13, 2012; 61/628,006 filed Oct. 24, 2011; and 61/628,115 filed Oct. 25, 2011; each of which is hereby incorporated by reference.

FIELD OF THE INVENTION

Embodiments of the present invention relate to disrupter cannons used to disable explosive devices.

BACKGROUND OF THE INVENTION

Disrupter cannons are used by military, bomb squads, and other emergency service personnel to destroy and/or disable explosive devices including improvised explosive devices ("IED"), bombs, and ordinance.

Disrupter cannons propel a projectile to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Disrupter cannons may benefit, according to the various aspects of the present invention, from improvements in the firing assembly.

BRIEF DESCRIPTION OF THE DRAWING

Embodiments of the present invention will now be further described with reference to the drawing, wherein like designations denote like elements, and:

FIG. 1 is a close-up view of the firing mechanism of FIG. 3 before or after firing the disrupter cannon.

DETAILED DESCRIPTION OF THE PREFERRED EMBODIMENTS

Figure 1:
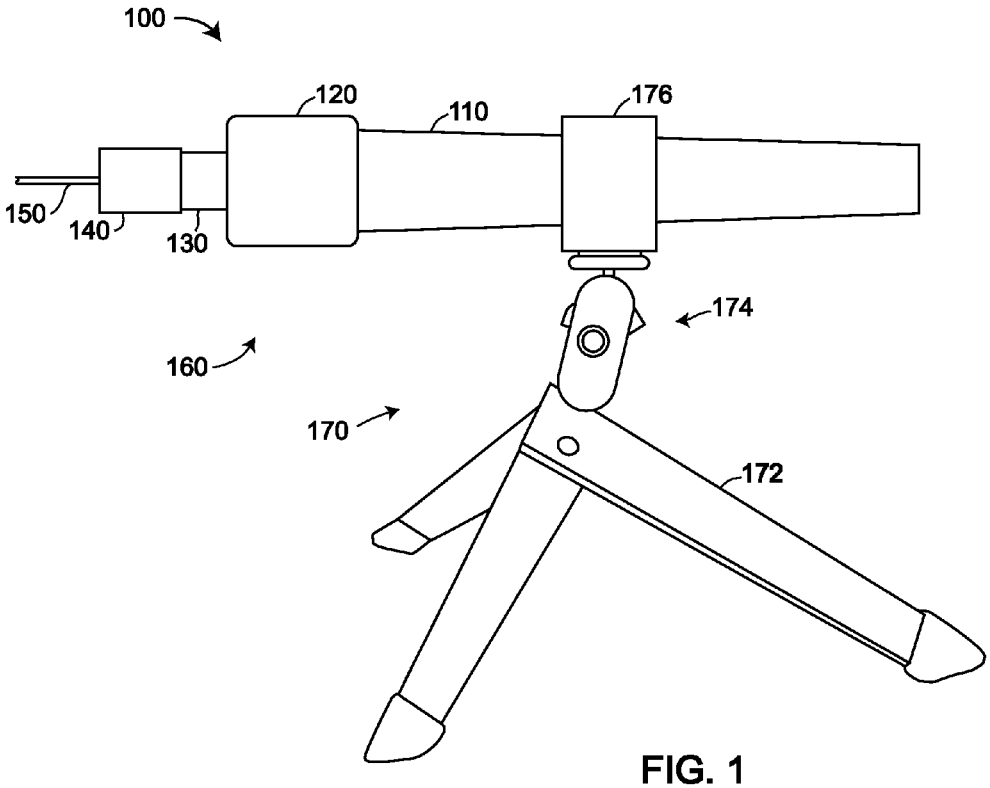
FIG. 1 is a plan view of a disrupter system.

Disrupter system 100 may be used to disable and/or destroy explosive devices. Disrupter cannon 160 may propel a projectile for disabling and/or destroying explosive devices. Mount 170 positions and supports disrupter cannon 160 for propelling a projectile toward an explosive device. Mount 170 may include holder 176, positioner 174, and tripod 172.

Holder 176 couples to (e.g., holds, clamps to, secures) disrupter cannon 160. Holder couples to positioner 174.

Holder 176 may couple to disrupter cannon 160 prior to firing disrupter cannon 160. Holder 176 may couple to disrupter cannon 160 after firing disrupter cannon 160 or holder 176 may release disrupter cannon 160 responsive to a recoil force to allow disrupter cannon 160 to separate from holder 176 and thereby from mount 170.

Positioner 174 moves to position disrupter cannon 160 so that the trajectory of the projectile launched by disrupter cannon 160 is directed toward an explosive device. Positioner 174 may orient disrupter cannon 160 so that the muzzle of barrel 110 of disrupter cannon 160 is oriented in an upward, a downward, or a horizontal direction with respect to the ground (e.g., a direction of a force of gravity). The position of positioner 174 may be locked (e.g., held, made immobile) to retain the orientation (e.g., aim) of disrupter cannon 160.

Tripod 172 supports the weight of disrupter cannon 160. Tripod 172 may include any conventional tripod or support for supporting equipment (e.g., cameras, guns, cannons). Tripod 172 may be position a distance away from an explosive device that is with the range of travel of the projectile launched from the cannon. In many situations, tripod 173 is positioned with respect to an explosive device so that the disrupter cannon is in the range of 6 to 48 inches, preferably 16 to 22 inches, away from the explosive device. Tripod 172 may move responsive to a recoil force of firing disrupter cannon 176.

Disrupter cannon 160 may include shield 140, firing assembly 130, breech cap 120, and barrel 110. Disrupter cannon 160 may cooperate with shock tube 150 and cartridge 380 to launch projectile 350.

A disrupter cannon propels a projectile by producing a rapidly expanding gas. The rapidly expanding gas is generally produced by burning a pyrotechnic (e.g., gun powder, explosive charge). Generally, the pyrotechnic is held in a cartridge. Firing (e.g., activating, igniting) the cartridge burns the pyrotechnic. A pyrotechnic of a cartridge may be ignited by operation of a firing pin.

Present disrupter cannons use a spring to return the firing pin to its pre-firing position. The force that moves the firing pin from the pre-firing position to the firing position to activate the cartridge is provided by shock tube 150. Shock tube 150 includes a pyrotechnic that when burned moves a gas along an inner diameter of shock tube 150. The expanding gas moves out of an end of shock tube 150 to apply a force on the firing pin to move the firing pin to activate the cartridge. Residue from the gas from shock tube 150 or from a subsequent firing of a cartridge may coat the spring.

The expanding gas produced by the burning pyrotechnic of a conventional cartridge may also enter the firing assembly and coat the spring with a residue. Further, the primer of a conventional cartridge may be destroyed during the firing process thereby permitting the conventional cartridge to blow gas, primer remains, and residue into the firing assembly. The gas from a cartridge may produce an amount of residue that is significantly greater than the residue produced by a shock tube.

Residue and other contaminants may prevent a spring from returning the firing pin to the pre-firing position. Residue and other contaminants may reduce a force provided by a spring thereby interfering with the operation of the firing assembly. Generally, proper operation of the firing assembly can be restored by disassembling and cleaning the firing assembly.

According to various aspects of the present invention, firing pin 440 may cooperate with magnet 436 to return firing pin 440 to its pre-firing position and to reduce an effect of residue on the movement of firing pin 440.

Figure 2:
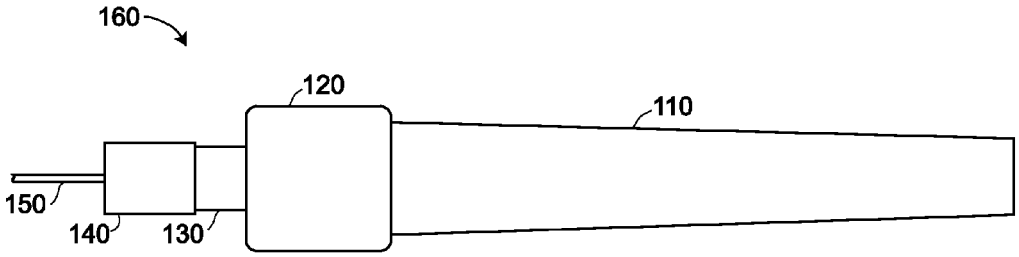
FIG. 2 is a plan view of a disrupter cannon according to various aspects of the present invention.
Figure 3:
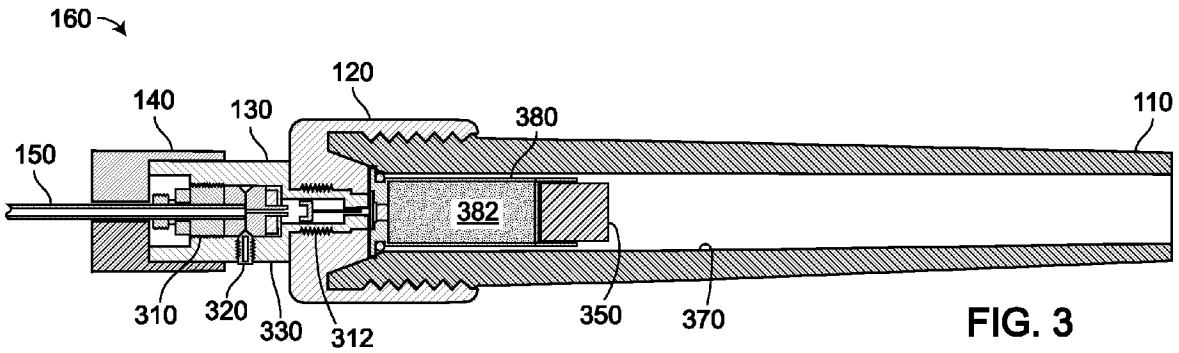
FIG. 3 is a cross-section view of the disrupter cannon of FIG. 2 along a central axis.
Figure 4:
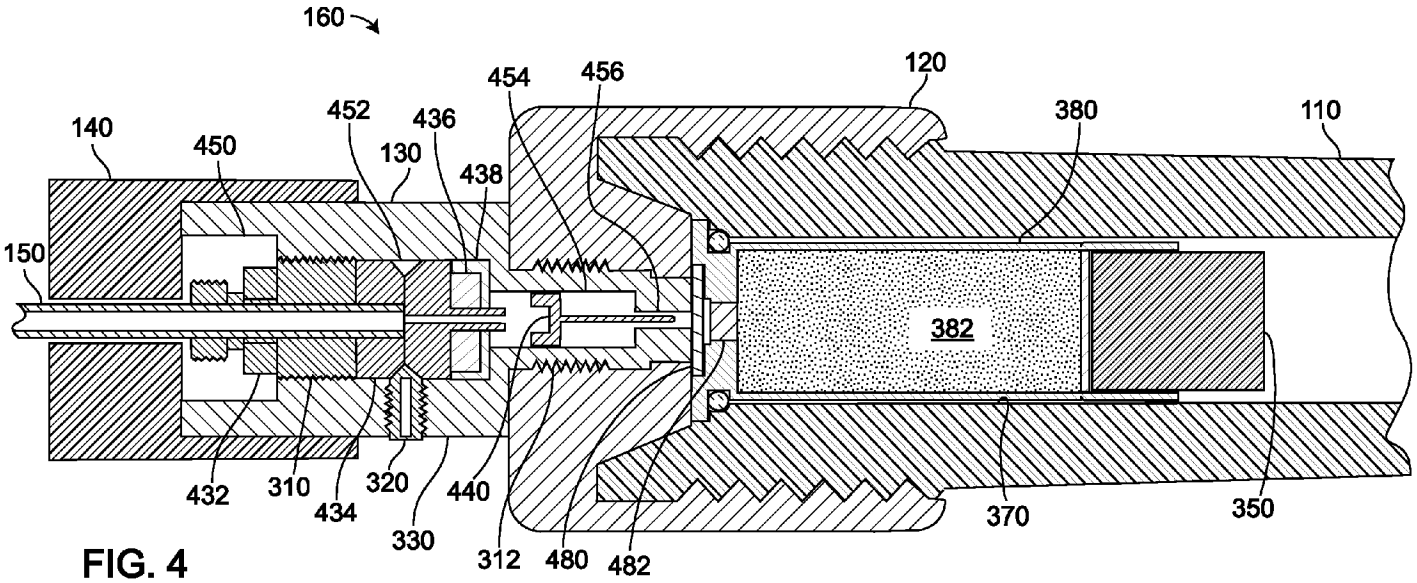
FIG. 4 is a close-up view of the cross-section view of FIG. 3 toward the breech end portion of the disrupter cannon.
Figure 5:
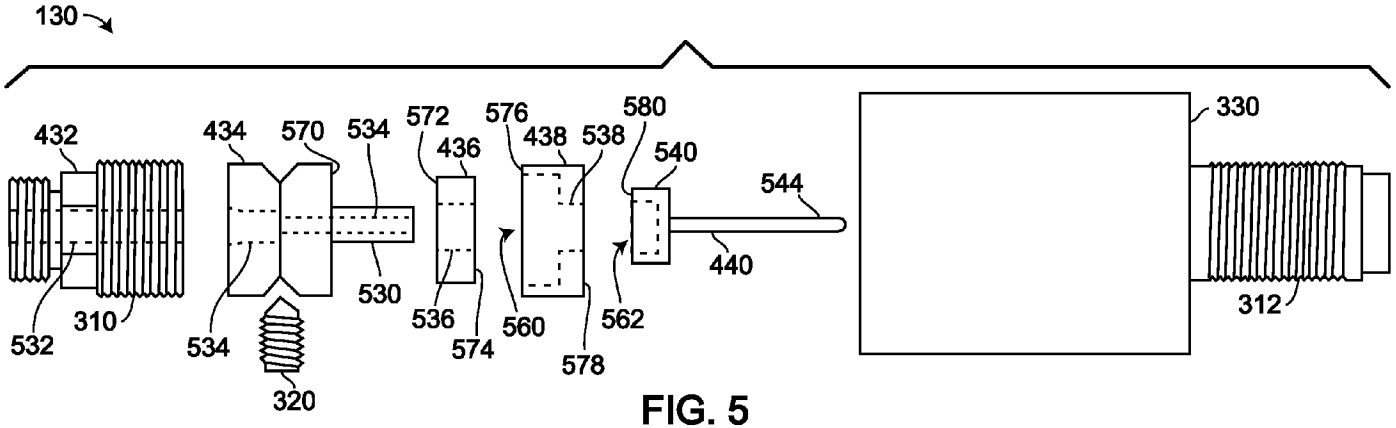
FIG. 5 is an exploded view of the firing assembly of FIG. 3.
Figure 6:
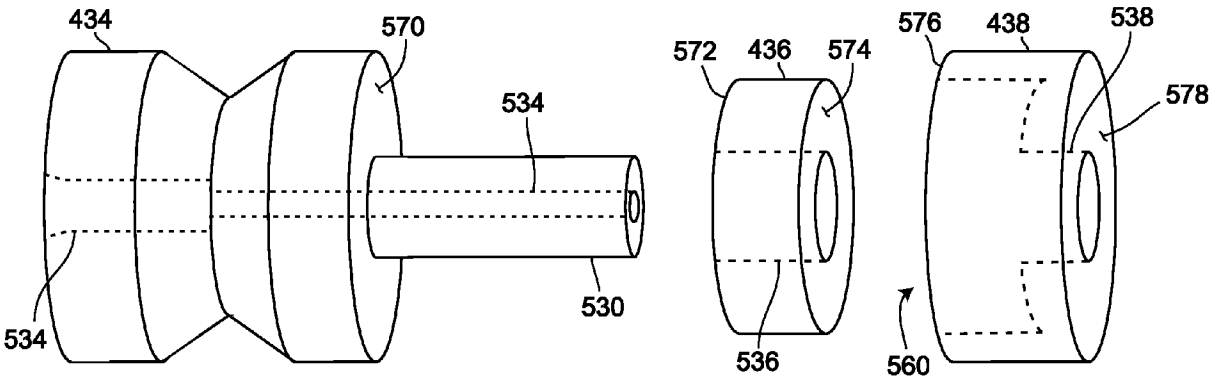
FIG. 6 is an exploded perspective view of the retainer, magnet, and cover of FIG. 5.

The components of disrupter cannon 160 and their cooperation are discussed below. Herein, the term "forward" refers to the direction of travel of a launched projectile. A first component may be positioned "forward of", "in front of", or "ahead of" a second component if the first component is between the second component and the direction of travel of a launched projectile. For example, the disrupter cannon of FIGS. 1-2 launch a projectile toward the right hand side of the page, so barrel 110 is forward of breech cap 120 and breech cap 120 is "behind", "toward the rear", or "rearward" of barrel 110. In the drawing, the forward direction and/or position is to the right of the page.

A barrel includes a muzzle end portion (e.g., exit), a breech end portion (e.g., rear), and a bore therebetween. Prior to firing, the bore of the barrel holds (e.g., contains, retains) a projectile and a cartridge. Upon firing the cartridge, the barrel in cooperation with breech cap 120, contains, at least in part and for a period of time, the force provided by the rapidly expanding gas generated by burning the pyrotechnic of the cartridge. The barrel and breech cap direct the force provided by the rapidly expanding gas against the projectile. The force moves the projectile from the breech end portion of the barrel toward the muzzle end portion of the barrel along the bore until the projectile exits the barrel at the muzzle end portion of the barrel. A barrel directs an initial flight path of the projectile. The projectile continues along the trajectory established by the barrel after the projectile exits the barrel. A material for a barrel may include a lightweight composite material and/or a metal.

A diameter of the bore of a barrel may be suitable to allow passage of projectiles (e.g., bullets, shells) of conventional caliber and/or to accept any conventional cartridge. In one implementation, the barrel receives a conventional 12-gauge shotgun shell in the breech end of the barrel. A surface of the bore may be smooth or rifled. A length of a barrel for a disrupter cannon may be in the range of 10 inches to 30 inches.

In an implementation, barrel 110 is formed of titanium and an external surface of barrel 110 is wrapped in carbon fiber. In another implementation, barrel 110 is formed of stainless steel.

A breech cap removeably couples to the breech end portion of a barrel. A breech cap forms a chamber at the breech end portion of the barrel. The chamber formed by a breech cap retains a cartridge in the breech end portion of a barrel. A firing assembly may couple to a breech cap. A breech cap positions the firing assembly for activating the cartridge. A breech cap cooperates with the barrel to contain and direct a force of the rapidly expanding gas provided by the cartridge as discussed above. In operation, the expanding gas provided by a cartridge cannot readily exit the chamber formed at the breech end portion of the barrel, so the breech cap directs the force of the expanding gas forward toward the muzzle end portion of the barrel and against the projectile.

A coupling between a breech cap and a barrel must be sufficiently strong for the breech cap to remain coupled to the barrel during firing of the cartridge and launch of the projectile. Any coupling mechanism (e.g., threads, bayonet, latch) that can withstand the force of the expanding gas provide by the cartridge is suitable for coupling the breech cap to the barrel. A breech cap may be removeably coupled (e.g., hinged, threaded) to a barrel. A breech cap may be completely removable (e.g., disconnected, decoupled) from a barrel.

A firing assembly activates the cartridge to launch the projectile. A firing assembly may activate the cartridge responsive to an action taken by an operator of the disrupter cannon. A firing assembly may operate as a transducer in that it transforms one form of energy into another form of energy to activate the cartridge.

For example, a firing assembly for an electrically fired cartridge may translate the movement of an operator's digit into an electrical signal that activates the cartridge. A firing assembly for a mechanically fired cartridge may translate an electrical signal or mechanical movement into movement (e.g., displacement) of a firing pin that strikes the cartridge to activate the cartridge. A firing assembly may translate a force provided by an expanding gas (e.g., shock tube) into movement of the firing pin to strike the cartridge.

Prior to firing a disrupter cannon, the firing pin of a mechanical firing assembly is positioned away from the cartridge. To fire the cartridge, the firing pin moves toward the cartridge to strike the primer of the cartridge to fire (e.g., ignite, activate) the cartridge. Preferably, after firing the cartridge, the firing pin returns to the pre-firing position to be ready to fire a subsequent cartridge. Preferably, the firing pin returns to the pre-firing position without manual intervention by a human. Generally, a force is applied to move the firing pin from the forward (e.g., firing) position back to the pre-firing position. As discussed above, such force is conventionally provided by a spring.

Figure 7:
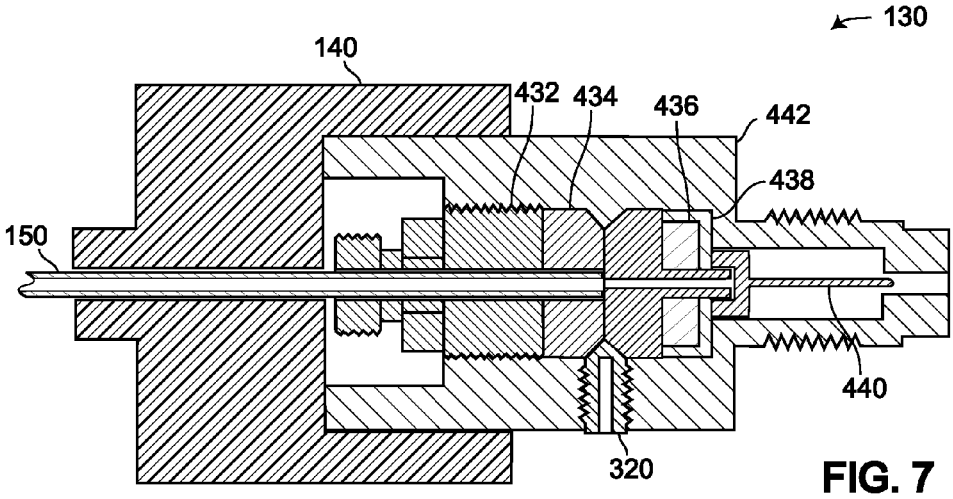
Figure 8:
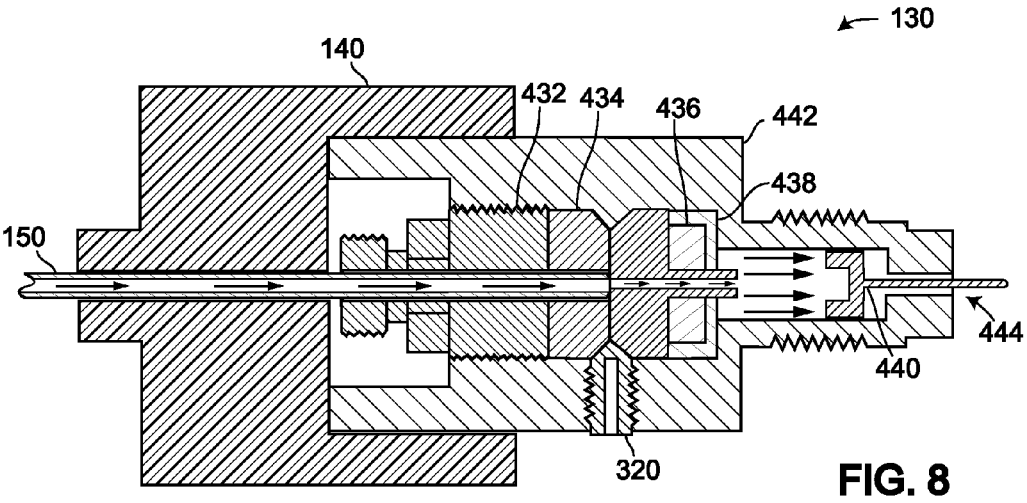
FIG. 8 is a close-up view of the firing mechanism of FIG. 3 during firing the disrupter cannon.

In an implementation, shock tube 150 provides a force of an expanding gas to move firing pin 440 from the pre-firing position, as shown in FIG. 7, to the firing position, as shown in FIG. 8. The expanding gas provided by shock tube 150, as discussed above, is provided by burning a pyrotechnic in the interior bore (e.g., cavity, passage) of the shock tube. The gas provided by the burning pyrotechnic of shock tube 150 moves along a length of shock tube 150 and exits the ends of shock tube 150. Passages (e.g., 534) within firing assembly 130 transmit the expanding gas from shock tube 150 to base 540 of firing pin 440. The force provided by the expanding gas from shock tube 150 moves firing pin 440 rapidly forward from the pre-firing position to the firing position to ignite cartridge 380.

In a pre-firing position, firing pin 440 may be proximate to magnet 436 and even contact cover 438. In a firing position, firing pin 440 is positioned distal from magnet 436 and cover 438. In the firing position, firing pin 440 may be positioned toward a forward wall of cavity 454 and even contact a forward portion of housing 330. Firing pin 440 in FIG. 8 is positioned a distance away from contacting a forward portion of housing 330. Movement of firing pin 440 further forward in FIG. 8 would position firing pin 440 in contact with the forward wall of cavity 454 and the forward portion of housing 330.

To operate disrupter cannon 160, a projectile is positioned in bore 370 of barrel 110 forward of cartridge 380, which is also positioned in bore 370 of barrel 110. Beech cap 120 is coupled to the breech end portion of barrel 110. Firing assembly 130 is coupled to breech cap 120. Shock tube 150 is inserted into firing assembly 130. Shield couples to the rear portion of firing assembly 130 and shock tube 150.

In an implementation, firing assembly 130 is threadedly coupled to breech cap 120 using threads 312. While firing assembly 130 is coupled to breech cap 130, firing pin 440 is positioned along the central axis of barrel 110 and cartridge 380. Cartridge 380 includes primer 482, and pyrotechnic 382. Cartridge 380 may further include plate 480. Cartridge 380 performs the functions of a cartridge discussed above.

As discussed above, a pyrotechnic produces a rapidly expanding gas. A pyrotechnic may experience a chemical reaction (e.g., burning) to produce the rapidly expanding gas. The rapidly expanding gas may provide a force. The force may launch a projectile. The force may move a firing pin. A magnitude of a force provided by a rapidly expanding gas may vary over time. Variance of the magnitude of the force over time may be referred to as a profile of the force (e.g., force profile). The force profile may start with ignition of the pyrotechnic and end when the pyrotechnic is exhausted.

A primer ignites a pyrotechnic of a cartridge to produce a rapidly expanding gas. A primer translates a physical force (e.g., being struck) into a chemical reaction (e.g., burning) that ignites the pyrotechnic. A physical force activates (e.g., ignites) the primer. A primer is generally positioned along a central axis that is along a length of the cartridge. A primer is positioned in-line with a firing pin.

A plate may cover a primer. A plate deforms responsive to being struck by a firing pin. A deformation in a plate contacts a primer to activate (e.g., strike) a primer. A plate remains coupled to the cartridge during firing of a primer and subsequent burning of the pyrotechnic of the cartridge. A plate impedes rearward movement of the primer, responsive to a force of the expanding gas, towards the firing assembly. A plate reduces an amount of gas that may exit the cartridge via the primer. A plate reduces the amount of residue and/or primer fragments carried into a firing assembly. A plate restrains movement of the primer before, during, and after firing the cartridge. In an implementation, plate 480 covers primer 482. Plate 480 reduces the residue that escapes from cartridge 380 during firing that may enter firing mechanism 130.

Plate 480 cooperates with firing pin 440 to activate primer 482. When struck by firing pin 440, plate 480 deforms. The force applied by firing pin 440 on plate 480 forms an indentation on one (e.g., rear, rearward) side of plate 480. Preferably, firing pin 440 forms the indentation in plate 480 without causing discontinuities (e.g., tears, holes, punctures, perforations) in the material of plate 480 as a discontinuity would permit gas to escape from cartridge 380 into firing assembly 130. On the other (e.g., front, forward) side of plate 480, the side proximate to primer 482, the indentation forms a protrusion. The protrusion contacts primer 482, with a sufficient force of impact, to activate primer 482. The protrusion protrudes forward toward primer 482.

In an implementation, plate 480 is 0.015 inches thick and formed of a soft aluminum. Plate 480 is coupled to cartridge 380 using an adhesive (e.g., super glue). Firing pin 440 forms an indentation in the soft aluminum of plate 480 to ignite primer 482 without destroying the structural integrity of plate 480. The protrusion formed by firing pin 440 strikes primer 482 to ignite pyrotechnic 382. Activating (e.g., actuating, firing) primer 482 ignites pyrotechnic 382. Burning pyrotechnic 382 produces a rapidly expanding gas, heat, and by-products (e.g., residue) from the chemical reaction of burning. The expanding gas increases the atmospheric pressure inside barrel 110.

Activating primer 482 may consume and/or weaken a portion of primer 482 so that the force of the expanding gas produced by pyrotechnic 382 may force primer 482 to decouple from cartridge 380. The force of the expanding gas may force primer 482 against plate 480. Preferably, as discussed above, plate 480 does not decouple from cartridge 380 when struck by primer 482. The expanding gas may further exit from cartridge 380 via primer 482. Preferably, plate 480 does not decoupled from cartridge 380 responsive to the force of the expanding gas that may bypass primer 482 or escape via the hole (e.g., bore) from which primer 482 was dislodged. Plate 480 detains primer 482 so that primer 482, when decoupled by the force of the expanding gas, does not strike firing assembly 130 and/or firing pin 440. Plate 480 retains the expanding gas, residue, and by-products in cartridge 380 to reduce the amount of expanding gas from cartridge 380 that enters firing assembly 130.

Firing assembly 130 includes housing 330, plug 432, retainer 434, magnet 436, cover 438, set screw 320, and firing pin 440. Housing includes threads 312 for coupling firing assembly 130 to breech cap 120, bores 450-456 for retaining the components of firing assembly 130 inside housing 330, and threads 310 for coupling to plug 432. Shield 140 covers a rear portion of firing assembly 130 to protect it from dirt and contaminants. Firing assembly 130 cooperates with shock tube 150 to fire disrupter cannon 160.

Firing assembly 130 and firing pin 440 perform the functions of a firing assembly and a firing pin respectively discussed above.

A housing retains the components of a firing assembly. A housing couples to a breech cap. A housing positions a firing pin relative to cartridge. A housing protects the components of a firing assembly from shock during firing (e.g., operation) of a disrupter cannon. A housing includes a cavity (e.g., bore, passage, open cross-section) for receiving the components of a firing assembly. A housing includes an opening for receiving the components of the firing assembly into the cavity. The components of the firing assembly are inserted through the opening during assembly. The components are removed via the opening when removing the components of the firing assembly for maintenance (e.g., cleaning, repair). A housing includes an opening for exit of at least a portion (e.g., rod) of a firing pin to activate a primer of a cartridge. A firing pin may momentarily protrude from the opening of the housing. A firing pin may withdraw back into the housing.

A retainer positions components of the firing assembly in the cavity of the housing. A retainer retains components of the firing assembly in the cavity. A retainer may include structures for positioning other components of the firing assembly. A retainer may include structures for retaining (e.g., holding, securing) other components of the firing assembly in position. A retainer may include structures for delivering an expanding gas directly to a firing pin. A retainer may cooperate with other components to deliver an expanding gas to a firing pin.

Structures for delivering an expanding gas to a firing pin include one or more passages (e.g., bores). Structures for retaining, positioning, and delivering may include a protrusion. A passage may extend through a protrusion. A passage through a protrusion may receive an expanding gas from a shock tube. A passage through a protrusion may direct the flow of gas toward a firing pin to move the firing pin from a pre-firing position to a firing position.

A set screw may hold a retainer in place while in the housing. Positioning a retainer in a housing may form a chamber in a forward portion of the housing for holding a magnet, a cover, and a firing pin. A retainer may position a magnet and cover to cooperate with a firing pin to perform the functions of a firing assembly.

A firing pin moves responsive to a force. A firing pin may move responsive to a force controlled by a user of the disrupter cannon. A firing pin provides a force to activate a primer. As discussed above, a firing pin may move from a pre-firing position to a firing position responsive to an expanding gas from a shock tube. In a firing position, a firing pin activates a primer to ignite a pyrotechnic to launch a projectile. A firing pin may return (e.g., move) from the firing position to the pre-firing position.

A force from a shock tube may move a firing pin from a pre-firing position to a firing position. A different force may move the firing pin from the firing position to the pre-firing position. Both forces may originate from behind the firing pin to operate on the firing pin. For example, a force from the expanding gas from shock tube 150 pushes firing pin 440 forward from the pre-firing position to the firing position. A force provided by magnet 436 pulls firing pin 440 backward from the firing position to the pre-firing position. Both forces originate from behind firing pin 440, but act on firing pin 440 to move it different directions.

A tip of a firing pin is of a suitable size and/or shape for activating a primer. According to various aspects of the present invention, a tip of a firing pin is of a suitable size, shape, and/or length to dent (e.g., make an indentation in) a plate sufficiently to activate a primer as discussed above. The tip of firing pin 440 may be the end portion of rod 544 of firing pin 440.

The force that moves a firing pin toward a primer may be of sufficient magnitude to move the firing pin with sufficient momentum (e.g., velocity, force) to activate the primer. A force may be of sufficient magnitude so that the firing pin cooperates with a plate that covers the primer to activate the primer as discussed above. A firing pin may include a surface (e.g., interior surface of cavity 562) for receiving a force to move the firing pin from a pre-firing position to a firing position.

The force that returns the firing pin to the pre-firing position may have a different source and/or be of a different type of force than the force that moves the firing pin from the pre-firing position to the firing position. For example as discussed above, a force that moves the firing pin from a pre-firing position may include a force of an expanding gas whereas the force that returns the firing pin to the pre-firing position may include a spring force or a magnetic force.

The force that moves the firing pin from the firing position to the pre-firing position may be continuously exerted on the firing pin, but temporarily overcome by the force that moves the firing pin from the pre-firing position to the firing position. The magnitude of a force that acts on the firing pin to move the firing pin from the pre-firing position to the firing position may be constant or vary in accordance with the distance of the firing pin from the retainer. A magnitude of a force that acts on the firing pin to return the firing pin to the pre-firing position may vary in accordance with (e.g., proportional to) the distance of the firing pin from the retainer. The magnitude of the force that acts on the firing pin to return the firing pin to the pre-firing position may vary inversely with the distance from the retainer. For example, the force exerted on a firing pin to return the firing pin to the pre-firing position may decrease as the firing pin moves toward the cartridge.

A magnet may provide a magnetic field. A magnetic field may exert a force on an objected that is attracted or repelled by a magnetic field. The force provided by the magnetic field of a magnet may be described herein as a force of the magnet.

An expanding gas from a shock tube may provide the force for moving the firing pin from the pre-firing position to the firing position. A magnet may provide a force for moving a firing pin from the firing position to the pre-firing position. A force from a magnetic field of a magnet may continuously act on a firing pin to attract the firing pin toward the magnet and away from the cartridge. A magnitude of the force of the expanding gas from the shock tube may overcome the magnitude of the attractive force of the magnet to move firing pin away from the magnet toward the cartridge. The magnitude of the force on the firing pin provided by the expanding gas of the shock tube may be sufficiently greater than the attractive force of the magnet on the firing pin to move the firing pin forward with sufficient momentum to activate the primer.

The difference between the magnitude of the force of the expanding gas acting on the firing pin and the magnitude of the force of the magnet acting on the firing pin may be described as a net force. When the magnitude of the force of the expanding gas on the firing pin is greater than the magnitude of the force of the magnet on the firing pin, the net force is a forward force that moves the firing pin toward the firing position. When the magnitude of the force of the expanding gas on the firing pin is less than the magnitude of the force of the magnet on the firing pin, the net force is a rearward force that moves the firing pin toward the pre-firing position.

A magnet may be positioned forward of the retainer. A magnet may include a bore that permits passage of the expanding gas from a shock tube to the firing pin. A magnet may include a bore for accepting a protrusion of a retainer that permits passage of the expanding gas from a shock tube. A magnet may couple to a retainer.

A magnet may include a ferromagnetic magnet and/or an electromagnetic magnet. A magnet may be formed of iron and alloys thereof. A magnet may include rare earth metals. A magnet may be formed of a lodestone. A magnet may provide a magnitude of a magnetic force in excess of 1 tesla.

A cover may couple to a retainer and/or a magnet. A cover may cover a magnet. A cover may encircle and/or cover a forward portion of a magnet. A cover, or at least a portion thereof, may be positioned between a magnet and a firing pin. A cover may protect a magnet from the force exerted by movements of the firing pin. A cover may protect the magnet from being broken by movement of the firing pin. A cover may include a bore (e.g., passage, opening, hole) that permits passage of an expanding gas to move a firing pin from a pre-firing position to a firing position. A cover may include a bore for accepting a protrusion of a retainer that permits passage of (e.g., delivers) the expanding gas from a shock tube.

A plug is positioned in the cavity of the housing behind the retainer. A plug couples to the housing. A plug provides an addition force of coupling to retain the components of the firing assembly in the housing during operation of the disrupter cannon. A plug may position a shock tube relative to the components of a firing assembly. A plug may couple to (e.g., retain, hold) a shock tube for operation of the disrupter cannon. A plug may include a bore for removeably receiving and holding a shock tube.

A shield may cover a rear portion of a housing, with or without the components of the firing assembly positioned in the housing. A shield reduces an amount of dirt and/or contaminates that enters a firing assembly. A shield may further support and/or retain a shock tube. A shield may include a bore for receiving a shock tube for coupling to the components of a firing assembly. A shield may remain coupled to a firing assembly during use of the disrupter cannon. A shield may couple to the housing of a firing assembly by friction fit.

In an implementation, housing 330 includes internal cavities (e.g., bores, passages) of four different diameters. The smallest diameter cavity 456 is positioned in the forward most portion of housing 330 and opens to the outside of housing 330. The forward portion of firing pin 440 exits passage 456 to ignite cartridge 380.

The largest diameter cavity 450 is positioned in the rearward most portion of housing 330 and is open to the outside of housing 330. The components of firing assembly 130 are inserted into housing 330 for assembly via the opening in cavity 450.

Cavity 452 is positioned forward of and contiguous to cavity 450. The internal wall of cavity 452 includes threads 310 for holding plug 432 in cavity 452. The cross-sectional area (e.g., diameter) of cavity 452 is less than the cross-sectional area of cavity 450. Retainer 434, magnet 436, and cover 438 are positioned in cavity 452 while firing assembly 130 is assembled.

Cavity 454 is positioned forward of cavity 452. The cross-sectional area of cavity 454 is less than the cross-sectional area of cavity 452. Firing pin 440 is moveably positioned in cavity 454. Base 540 of firing pin 440 remains in cavity 454 during operation of disrupter cannon 160. Rod 544 of firing pin 440 is positioned at least partially in cavity 454 while firing pin 440 is in the pre-firing position. A portion of protrusion 530 of retainer 434 extends into cavity 454.

Cavity 456 is positioned forward of cavity 454. The cross-sectional area of cavity 456 is less than the cross-sectional area of cavity 454. Rod 544 of firing pin 440 moves forward and backward in cavity 456. Rod 544 of firing pin 440 exits the open end of housing 330 through cavity 456 to activate a primer 482. Rod 544 of firing pin 440 moves inside (e.g., into) housing 330 when firing pin 440 moves from the firing position to the pre-firing position. Base 540 of firing pin 440 remains in cavity 454 during operation, but moves along the length of cavity 454 between the pre-firing and firing positions.

In an implementation, the cavities are coaxial bores of different diameters.

While firing assembly 130 is assembled in housing 330, plug 432 couples to housing 330 using threads 310. Retainer 434 is held in cavity 452 by set screw 320. Protrusion 530 is positioned in passage 536 of magnet 436 and extends past (e.g., forward of) magnet 436. Protrusion 530 positions magnet 436 in cavity 452. Cover 438 is positioned over magnet 346. Magnet 436 fits inside cavity 560 of cover 438. Cover 438 includes passage 538. Protrusion 530 of retainer 434 is positioned in passage 538 and extends past (e.g., forward of) cover 438.

Magnet 436 is positioned such that the pole of magnet 432 that attracts firing pin 440 is oriented toward firing pin 440. Cover 438 is formed of a material that does not interfere with (e.g., plastic) or interferes minimally with (e.g., titanium) the magnetic field from magnet 436 so that the magnetic field of magnet 436 may attract firing pin 440 to move firing pin 440 to the pre-firing position.

Magnet 436 may be coupled to retainer 434 using any conventional coupling. In an implementation, magnet 436 is coupled to retainer 434 using an adhesive. Cover 438 may be coupled to magnet 436 and/or retainer 434 using any conventional coupling. In an implementation, cover 438 is coupled to magnet 436 and/or retainer 434 using an adhesive.

Shock tube 150 is removeably positioned through passage 532 in plug 432. Plug 432 retains shock tube 150 by friction. Shock tube 150 is further positioned in a portion of bore 534 of retainer 434.

The diameter of passage 536 of magnet 436 is greater than the outside diameter of protrusion 530, so passage 536 fits around protrusion 530 as magnet 436 is moved toward retainer 434 until face 572 of magnet 436 contacts face 570 of retainer 434. An adhesive may be applied between face 570 and 572 to couple magnet 436 to retainer 434. While face 570 contacts face 572, the end portion of protrusion 530 extends beyond face 574 of magnet 436.

The diameter of passage 538 of cover 438 is also greater than the outside diameter of protrusion 530, so passage 538 fits around protrusion 530. As cover 438 is moved toward retainer 434, magnet 436 enters cavity 560. Cover 438 is moved toward retainer 434 until face 576 of cover 438 contacts face 570 of retainer 434. In an embodiment, cover 438 completely covers the portion of magnet 436 that does not contact face 570 of retainer 434. An adhesive may be applied between face 570 and face 576 to couple cover 438 to retainer 434. An adhesive may be applied to face 574 of magnet 436 and an interior surface of cavity 560 to couple cover 438 to magnet 436. An adhesive may be applied around protrusion 530 and in any gap between protrusion 530 and passage 538.

Face 574 of magnet 436 may contact an inner surface of cavity 562 of cover 438. Sides of magnet 436 may contact an inner surface of cavity 562.

While face 572 of magnet 436 is in contact with face 570 of retainer 434 and face 576 of cover 438 contacts face 570 of retainer 434, a gap may exist between face 574 of magnet 436 and the forward inner surface of cavity 560 of cover 438. A gap between face 574 of magnet 436 and cover 438 may provide additional protection to magnet 436 against shock of impact of firing pin 440 against cover 438 and/or against the force and heat of the expanding gas provided by shock tube 150.

A gap between face 572 of magnet 436 and the inner surface of cavity 560 of retainer 438 may be filled with a material that absorbs a shock (e.g., energy, vibrations) of impact to further protect magnet 436 from impact of firing pin 440. A material for absorbing shock may include rubber and foam.

After magnet 436 and cover 438 are positioned on protrusion 530 of retainer 434, the end portion of protrusion 530 extends beyond face 578 of cover 438. After plug 432, retainer 434, magnet 436, and cover 438 are positioned in housing 442, protrusion 530 extends into cavity 454.

Base 540 of firing pin 440 includes cavity 562. While firing pin 440 is in the pre-firing position, face 580 of firing pin 440 contacts or is very close to face 578 of cover 578. The end portion of protrusion 530 that extends forward of face 578 of cover 438 is positioned in cavity 562 of firing pin 440 while firing pin 440 is in the pre-firing position.

As discussed above, shock tube 150 is a hollow tube. Shock tube 150 is open on the end portion that is inserted into plug 432 and retainer 434. The open end of shock tube 150 is in fluid communication with passage 534 through protrusion 530. Because protrusion 530 extends through magnet 436 and cover 438 into cavity 454, the expanding gas (e.g., fluid, air) provided by shock tube 150 passes through passage 534 into cavity 454 to apply a force on firing pin 440. Protrusion 530 permits the expanding gas from shock tube 150 to bypass passages in magnet 436 and cover 438 for delivery (e.g., provision) directly to firing pin 440.

Because the expanding gas bypasses magnet 436 and cover 438, the magnitude of the force provided by the expanding gas to firing pin 440 is not decreased by interference with magnet 436 and/or cover 438. Further, magnet 436 and cover 438 are not coated by the contaminates carried by the expanding gas of shock tube 150. Because the expanding gas is delivered directly into cavity 562 of firing pin 440, the magnitude of the force applied to firing pin 440 is close to if not the same as the maximum force provided by the expanding gas.

Using protrusion 530 to deliver the expanding gas past magnet 436 spares magnet 436 from being subjected to the explosive force and high heat of the expanding gas from shock tube 150. Experiments have shown that bypassing magnet 436 with protrusion 530 and protecting magnet 436 with cover 438 protects fragile magnets from being broken (e.g., fractured) by the operation of disrupter cannon 160. Experiments have shown that using protrusion 530 and cover 438 provide sufficient protection so that magnet 436 may be formed of fragile materials. For example, protrusion 530 and cover 438 protect a fragile rare earth neodymium ring magnet from being broken. Lacking protrusion 530 and/or cover 438, a magnet formed of such material would break when used in firing assembly 130.

Coupling magnet 436 to retainer 434, cover 438 to retainer 434, and/or magnet 436 to cover 438 provides additional protection against breakage.

The magnetic force from magnet 436 moves firing pin rearward in the firing chamber, as shown in FIG. 7, thereby positioning firing pin 440 in the pre-firing position. Firing pin 440 is formed of a material (e.g., ferrous) that is attracted by a magnetic force. The other components of firing assembly 130 are preferably formed of a material (e.g., non-ferrous) that is not affected or affected only in a minor way by a magnetic force (e.g., titanium, aluminum).

In an implementation, firing pin 440 is formed of a 17-4PH stainless steel alloy, retainer 434 is formed of titanium, cover 438 is formed of titanium, and magnet 436 is formed of rare earth neodymium.

As discussed above, in the pre-firing position, the end portion of rod 544 of firing pin 440 does not protrude from housing 330 as shown in FIG. 7. Firing pin 440 remains in the pre-firing position until the force of an expanding gas from shock tube 150 is applied to base 540 of firing pin 440. The magnitude of the force of the expanding gas overcomes the magnitude of the magnetic force of magnet 436. The force from the expanding gas moves firing pin 440 away from the pre-firing position. The force of the expanding gas, indicated by lines with arrow heads, moves firing pin 440 into the firing position as shown in FIG. 8. The force of the expanding gas moves firing pin 440 with sufficient speed and momentum to form an indentation in plate 480, activate primer 482, and activate cartridge 380.

As the pyrotechnic in shock tube 150 is expended, the magnitude of the force of the expanding gas from shock tube 150 decreases. At a threshold, the magnitude of the magnetic force from magnet 436 overcomes the force of the expanding gas from shock tube 150 to move firing pin 440 back to the pre-firing position.

Conventional disrupter cannons include a spring that applies a force that moves the firing pin from the firing position to the pre-firing position. A spring has several disadvantages. The operation of a spring is easily effected by residue (e.g., debris, burnt gun powder) from the expanding gas from the cartridge or the shock tube. Residue on the spring interferes with proper operation of the spring. Residue may affect the force provided by the spring to move the firing pin. A firing mechanism that includes a spring must be disassembled and cleaned frequently or the firing assembly ceases to function properly. Residue on cover 438 does not interfere with the force provided by magnet 436.

Further, when a spring either pulls the firing pin back toward the pre-firing position or pushes the firing pin toward the pre-firing position (e.g., away from bore 456), the amount of force required to move the firing pin increases as the firing pin moves away from the pre-firing position and toward the firing position.

For example, a spring attached to the rear portion of the firing pin stretches as the firing pin moves away from the pre-firing position. As the spring stretches, the force the spring applies on the firing pin increases. If a spring is positioned between the firing pin and the forward portion of the firing pin chamber, as the firing pin moves toward the cartridge, the spring is compressed to return the firing pin to the pre-firing position. As the spring is compressed, the force applied by the spring on the firing pin increases.

If the magnitude of the force applied by shock tube 150 to move the firing pin is constant, the momentum of the firing pin may actually decrease as the firing pin moves away from the pre-firing position. A decrease in the magnitude of the firing pin as it moves from the pre-firing position to the firing position may decrease reliable firing of the disrupter cannon. The amount of force exerted by the spring may increase as the spring is coated with residue. Further, the displacement of the spring may decrease as it is coated with residue.

The magnitude of the force applied by magnet 436 on firing pin 440 decreases as firing pin 440 moves away from the pre-firing position. If the magnitude of the force applied to move firing pin 440 away from the pre-firing position is constant, the momentum of the firing pin may actually increase as firing pin 440 moves away from the pre-firing position. An increase in momentum as firing pin 440 moves from the pre-firing position to the firing position may increase the likelihood of consistently firing the cartridge.

Magnet 436 eliminates a spring for moving firing pin 440 from the firing position to the pre-firing position. The force applied by magnet 436 is less affected by residue. Magnet 436 more reliably moves firing pin 440 from the firing position to the pre-firing position. Residue is less of an impediment to movement of firing pin 440 when magnet 436 provides the return force as opposed to a spring.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A disrupter cannon for launching a provided projectile toward an explosive device to disable or destroy the explosive device, the disrupter cannon comprising:

a barrel;

a breech cap coupled to the barrel;

a firing assembly coupled to the breech cap, the firing assembly comprising a housing, a retainer, a magnet, a cover, and a firing pin, the housing having a first passage therethrough; wherein:

the retainer, the magnet, the cover, and the firing pin are positioned in the first passage of the housing;

the retainer has a protrusion and a second passage therethrough, a portion of the second passage through the protrusion;

the magnet has a third passage therethrough, the magnet positioned proximate to the retainer, the protrusion positioned through the third passage such that the protrusion extends past the magnet;

the cover having a forth passage therethrough, the cover positioned proximate to the magnet, the protrusion positioned through the forth passage such that the protrusion extends past the cover; and the firing pin including a base and a rod;

the cover is positioned between the magnet and the firing pin such that the firing pin does not contact the magnet;

in a pre-firing position, the firing pin is proximate to the cover, the protrusion is positioned proximate to the base, the rod is positioned in the housing;

a force of an expanding gas transmitted via the passage through the protrusion directly to the base moves the firing pin from the pre-firing position to a firing position;

in the firing position, an end portion of the rod extends from the housing to launch a provided projectile;

as a magnitude of the force of the expanding gas decreases, a force of a magnetic field of the magnet moves the firing pin from the firing position to the pre-firing position.

2. The firing assembly of claim 1 wherein:

the base of the firing pin includes a cavity;

in the pre-firing position, an end portion of the protrusion is positioned in the cavity.

3. The firing assembly of claim 1 wherein the first passage, the second passage, the third passage, and the fourth passage are coaxial.

4. The firing assembly of claim 1 wherein:

the cover includes a cavity;

the magnet is positioned in the cavity such that the cover covers the magnet.

5. The firing assembly of claim 1 wherein the magnet couples to the retainer.

6. The firing assembly of claim 1 wherein an adhesive couples the magnet to the retainer.

7. The firing assembly of claim 1 wherein the cover couples to at least one of the retainer and the magnet.

8. The firing assembly of claim 1 wherein an adhesive couples the cover to at least one of the retainer and the magnet.

9. The firing assembly of claim 1 wherein:

a rearward face of the magnet contacts a forward face of the retainer;

a forward face of the magnet contacts a rearward face of the cover.

10. A firing assembly for a disrupter cannon, the firing assembly comprising:

a retainer having a protrusion and a first passage therethrough, a magnet having a second passage therethrough, the magnet positioned proximate to the retainer, a cover having a third passage therethrough, the cover positioned proximate to the magnet, a firing pin including a base and a rod, wherein the cover is positioned between the magnet and the firing pin such that the firing pin does not contact the magnet;

in a pre-firing position, the firing pin is proximate to the cover, the protrusion is positioned proximate to the base;

a force of an expanding gas transmitted via the first passage through the protrusion directly to the base moves the firing pin from the pre-firing position to a firing position to launch a provided projectile;

as a magnitude of the force of the expanding gas decreases, a force of a magnetic field of the magnet moves the firing pin from the firing position to the pre-firing position.

11. The firing assembly of claim 10 wherein:

the base of the firing pin includes a cavity;

in the pre-firing position, an end portion of the protrusion is positioned in the cavity.

12. The firing assembly of claim 10 wherein the first passage, the second passage, and the third passage are coaxial.

13. The firing assembly of claim 10 wherein:

the cover includes a cavity;

the magnet is positioned in the cavity such that the cover covers the magnet.

14. The firing assembly of claim 10 wherein the magnet couples to the retainer.

15. The firing assembly of claim 10 wherein an adhesive couples the magnet to the retainer.

16. The firing assembly of claim 10 wherein the cover couples to at least one of the retainer and the magnet.

17. The firing assembly of claim 10 wherein an adhesive couples the cover to at least one of the retainer and the magnet.

18. The firing assembly of claim 10 wherein:

a rearward face of the magnet contacts a forward face of the retainer.

* * * * *